United States Patent [19]

Kutik et al.

[11] 4,218,198

[45] Aug. 19, 1980

[54] PUMP HAVING NON-THROTTLING PERIPHERAL VALVE

[75] Inventors: Louis F. Kutik, Ft. Lauderdale; Howard E. Cecil, Miami Lakes, both of Fla.

[73] Assignee: Security Plastics, Inc., Miami Lakes, Fla.

[21] Appl. No.: 957,056

[22] Filed: Nov. 2, 1978

[51] Int. Cl.[3] ..... F04B 21/02; B67D 5/42

[52] U.S. Cl. ..... 417/566; 222/383; 222/384

[58] Field of Search ..... 417/566; 222/383, 384

[56] References Cited

U.S. PATENT DOCUMENTS

| | | | |
|---|---|---|---|
| 2,956,509 | 10/1960 | Cooprider et al. | 222/384 |
| 3,086,716 | 4/1963 | Rolb | 222/385 |
| 3,185,355 | 5/1965 | Lipmann | 222/384 |
| 4,046,292 | 9/1977 | Corsette | 222/383 |
| 4,155,487 | 5/1979 | Blake | 222/383 |
| 4,162,746 | 7/1979 | Anderson et al. | 222/384 |
| 4,168,788 | 9/1979 | Quinn | 222/383 |

*Primary Examiner*—William L. Freeh
*Attorney, Agent, or Firm*—Oltman and Flynn

[57] ABSTRACT

A dispensing pump is provided with a non-throttling peripheral valve having a circular sealing edge with a diameter of greater than ¾ inch and a thickness of less than 0.020 inch, and the valve is made of low density plastic material. The result is a pump which will operate at a very low, predetermined actuating pressure. A vent is included in the pump for venting a container to the atmosphere when air pressure in the container becomes reduced.

11 Claims, 21 Drawing Figures

PUMP HAVING NON-THROTTLING PERIPHERAL VALVE

BACKGROUND OF THE INVENTION

The pump disclosed and claimed herein is an improvement over the pumps described and claimed in U.S. Pat. Nos. 3,507,586 and 3,527,551. Those patents include peripheral valves, and the present invention improves the non-throttling characteristics of the peripheral valve and makes it open at a predetermined pressure. The invention also includes a vent for this particular type of pump.

SUMMARY OF THE INVENTION

There has been a need for a high volume, low pressure pump. The pump of the aforementioned U.S. Patent No. 3,507,586 includes a large area peripheral valve that makes the pump suitable for high volume application. However, it was not discovered until recently that a peripheral valve could be made that would only open at a desired low pressure and close at approximately the same pressure. This is accomplished by providing a flap member in the pump in which the diameter of the circular sealing edge is greater than ¾", the thickness of the circular sealing edge is less than 0.020", and the flap member is made of low density plastic material. Specifically, by observing these criteria, a pump can be made which will open and close at a very low pressure, say 2.5 pounds per square inch by way of example. In one embodiment, the entire flap member is movable vertically and will move down under pressure to assist in opening the pump at low pressure.

The pump also includes a special vent which serves to vent the container to which the pump is attached to the atmosphere so that any vacuum which builds up in the container during operation is equalized by admitting air to the container through the vent. The vent is so constructed that it prevents product from escaping from the container if the container, which may be pliable, is squeezed or if product otherwise reaches the vent.

Accordingly, it is an object of the present invention to provide a pump having a non-throttling peripheral valve that will open and close at a desired low pressure.

Another object of the invention is to vent a pump having a peripheral sealing valve so that low pressure in a container to which the pump is attached will be equalized with atmospheric pressure.

Another object of the invention is to provide a pump with an actuator which may be selectively locked.

Another object is to enable a peripheral valve in a pump to open and close at low pressure regardless of whether the peripheral valve is fixed or movable.

A further object of the invention is to provide a pump having a peripheral valve and an actuator which may be either a piston or a lever.

Other objects of this invention will appear from the following description and appended claims, reference being had to the accompanying drawings forming a part of this specification wherein like reference characters designate corresponding parts in the several views.

Before explaining the disclosed embodiments of the present invention in detail, it is to be understood that the invention is not limited in its application to the details of the particular arrangements shown, since the invention is capable of other embodiments. Also, the terminology used herein is for the purpose of description and not of limitation.

DESCRIPTION

Figures 1, 2, 3, 5, 6:
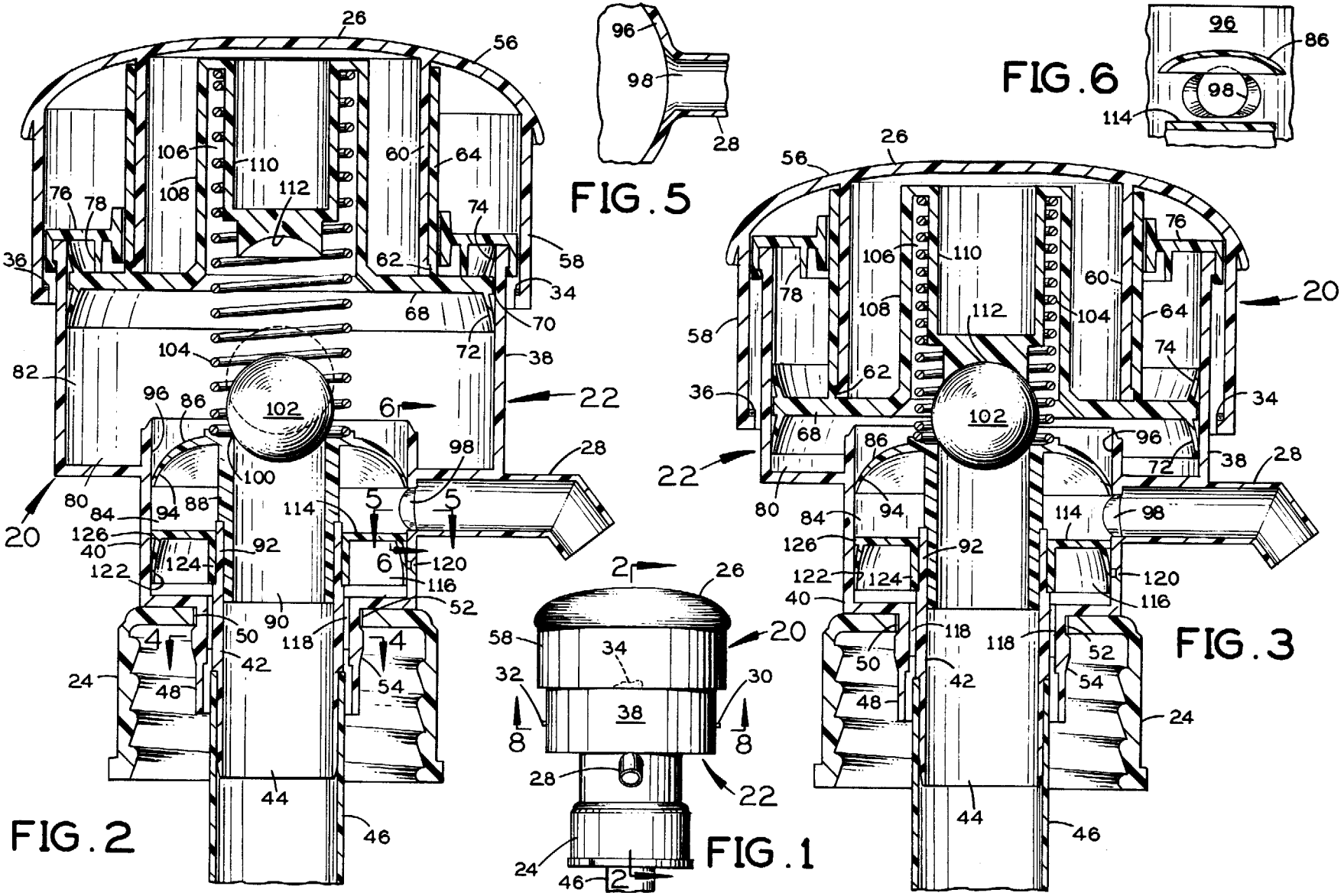
FIG. 1 is an elevational view of a pump in accordance with one embodiment of the invention.
FIG. 2 is a vertical sectional view taken along line 2—2 of FIG. 1.
FIG. 3 is a vertical sectional view similar to FIG. 2, but with the actuator of the pump in a depressed position.
FIG. 5 is a cross-sectional view of an outlet opening taken along line 5—5 of FIG. 2.
FIG. 6 is a vertical sectional view of the outlet opening taken along line 6—6 of FIG. 2.
Figure 4:
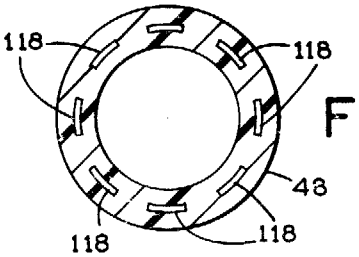
FIG. 4 is a cross-sectional view taken along line 4—4 of FIG. 2.
Figure 8:
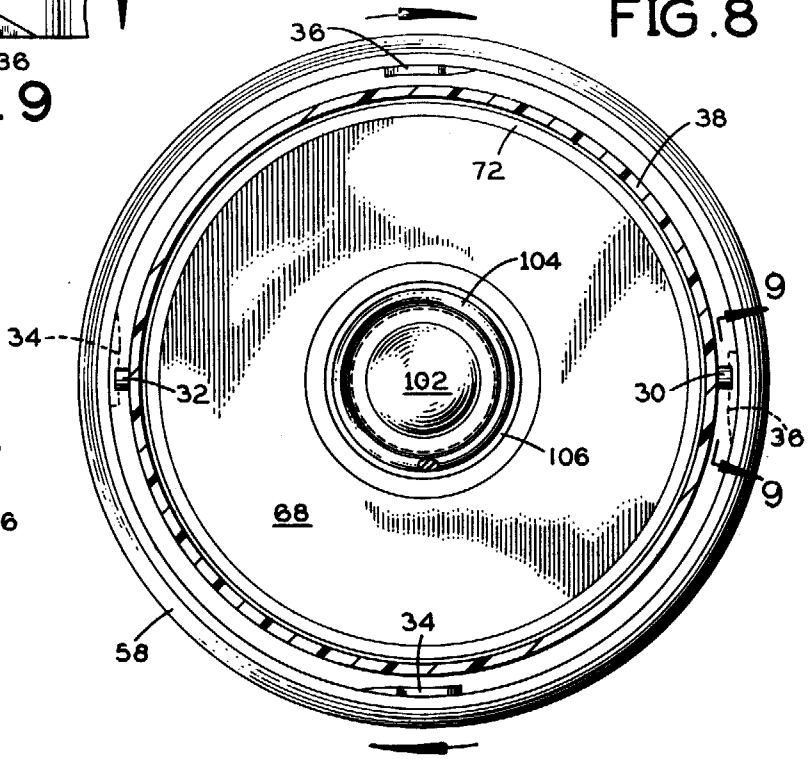
FIG. 8 is a cross-sectional view taken along line 8—8 of FIG. 1.

The pump 20 of FIG. 1 has a housing 22, a cap 24 for attaching the housing to a container, and an actuator 26 for operating the pump. Product emerges from a spout 28. There are locking projections 30 and 32 on the lateral sides of the housing 22, and locking cams 34 and 36 at the inside of the actuator (FIG. 8).

The housing 22 includes an annular enlarged portion 38 which is open at the top, and this opening is closed by the actuator 26. The housing 22 also includes a reduced diameter portion 40 from which the spout 28 projects. A still further reduced diameter portion 42 of the housing projects downwardly and forms a tip 44 to which a dip tube 46 is attached. The housing includes a rim 48 which is spaced outwardly from the portion 42, and this rim is recessed at 50 to receive the inner edge 52 of the cap 24 with a snap fit. The rim 48 includes a tapered portion at 54 providing a ramp over which the edge 52 may be slid when snapping the cap 24 onto the rim 48 and into the recess 50.

The actuator 26 is an assembly which includes an actuator cap 56 having an outer annular wall or flange 58 which is slidable vertically up and down relative to the outside of the enlarged tubular portion 38 of the housing 22. The cap 56 also includes an inner annular wall 60 that has a projection 62 received with a snap fit within a matching recess in a wall 64 of a piston 68 that is also part of the actuator assembly. The piston 68 includes a pressure ring 70 that closely, slidably fits the inside annular surface of the tubular portion 38 of the housing so that the piston can reciprocate vertically within the housing. The piston 68 also includes a downwardly projecting sealing skirt 72 that is resiliently biased against the inner surface of the tubular housing portion 38, and an upwardly projecting sealing skirt 74 that is also resiliently biased against the inner surface of the tubular housing portion 38. The sealing skirts will withstand pressure in opposite directions, and the pressure ring 70 which has a close fit with the housing portion 38 prevents the sealing skirts from being distorted and receiving a set.

The tubular portion 38 of the housing has a stop member 76 snapped over the top of it, and the stop member 76 includes a portion 78 which projects downwardly to engage the piston 68 when the piston is in its raised position as shown in FIG. 2. Thus, the stop member 76 defines the upper limit of movement of the piston 68.

The housing 22 defines a compartment 80 which is divided into an input chamber 82 and an output chamber 84 by a peripheral sealing flap 86 of a valve member 88. The valve member 88 provides both an inlet valve and an exhaust valve for the pump as will be described.

The valve member 88 includes a lower tubular portion 90 which fits tightly and sealingly within an upwardly projecting portion 92 of the housing 22. The resiliently flexible flap 86 projects outwardly from the tubular portion 90 and has a circular sealing edge 94 engaging the inside cylindrical surface 96 of the housing 22. The circular sealing edge 94 is slightly larger in diameter before assembly than the diameter of the cylindrical surface 96 so that the flap 86 bends slightly and is self biased against the cylindrical surface 96. The output chamber 84 is below the flap 86, and the spout 28 communicates with this output chamber through an outlet opening 98 formed in the housing 22. The circular sealing edge normally engages the cylindrical surface 96 just above the outlet opening 98.

The valve member 88 also includes an intake valve portion 100 that constitutes a valve seat for an intake valve ball 102. The ball 102 normally rests on the valve seat 100 so that the intake valve is closed. When product is sucked up into the pump, as will be explained, the intake valve ball 102 rises from the valve seat 100 to open the intake valve.

Figure 9:
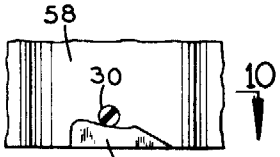
FIG. 9 is a fragmentary view of a locking arrangement included in the pump.
Figure 10:
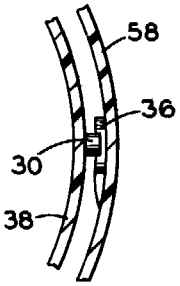
FIG. 10 is a sectional view taken along like 10—10 of FIG. 9.

A coil spring 104 encircles the ball 102 for retaining the ball in alignment with the valve seat 100 as it rises and falls during operation of the pump. The lower end of the spring 104 is seated on the top of the valve member 88, and the upper end of the spring 104 is received within a recess 106 formed by an upwardly projecting portion 108 of the piston 68. The piston 68 also includes a downwardly projecting portion 110 that has an upwardly concave surface 112 constituting a projection that is engageable with the ball 102 of the intake valve when the actuator 26 is in its fully depressed position as shown in FIG. 3. In this position, the ball 102 is locked on the valve seat 100, thus firmly closing the pump so that no product can escape during shipment and handling of the pump. The locking cams 34 and 36 are locked under the projections 30 and 32 in this locked condition of the pump as shown in FIG. 8. The actuator 26 is turned from its solid line position to the position wherein the locking cams 34 and 36 are shown in dashed lines under the projections 32 and 30. The engagement between a locking cam 36 and a projection 30 is shown in FIGS. 9 and 10.

When the actuator is turned back to the solid line position of FIG. 8, the spring 104 will push the actuator toward the raised position. The suction created in the input chamber 82 will cause the ball 102 to rise and product will be sucked through the dip tube and the inlet valve 88 into the input chamber 82. The outlet valve 86 will remain closed.

Figure 7:
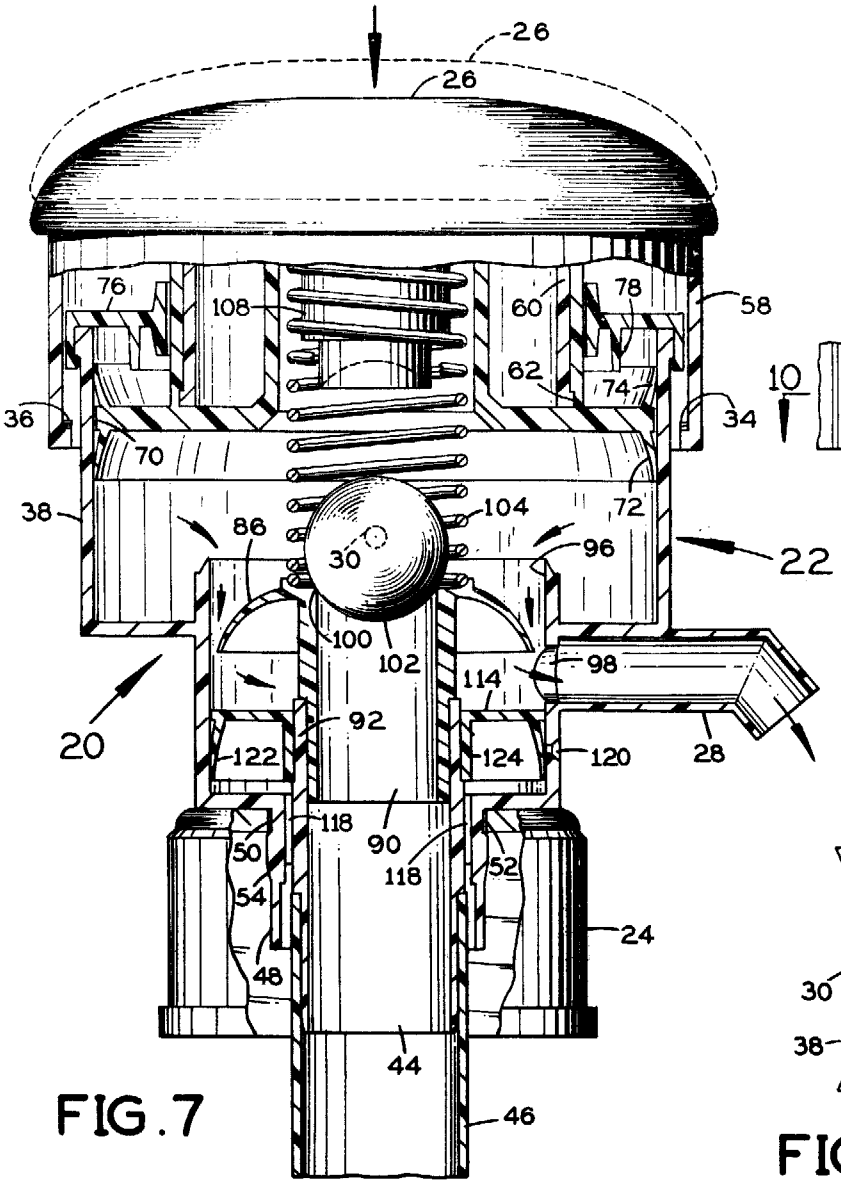
FIG. 7 is a vertical sectional view similar to FIG. 3 illustrating flow paths for escape of product.
Figure 11:
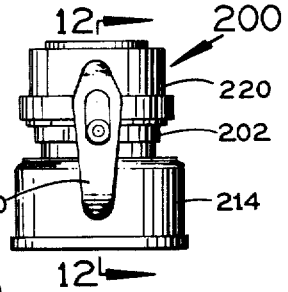
FIG. 11 is an elevational view of a pump constituting another embodiment of the invention.
Figure 12:
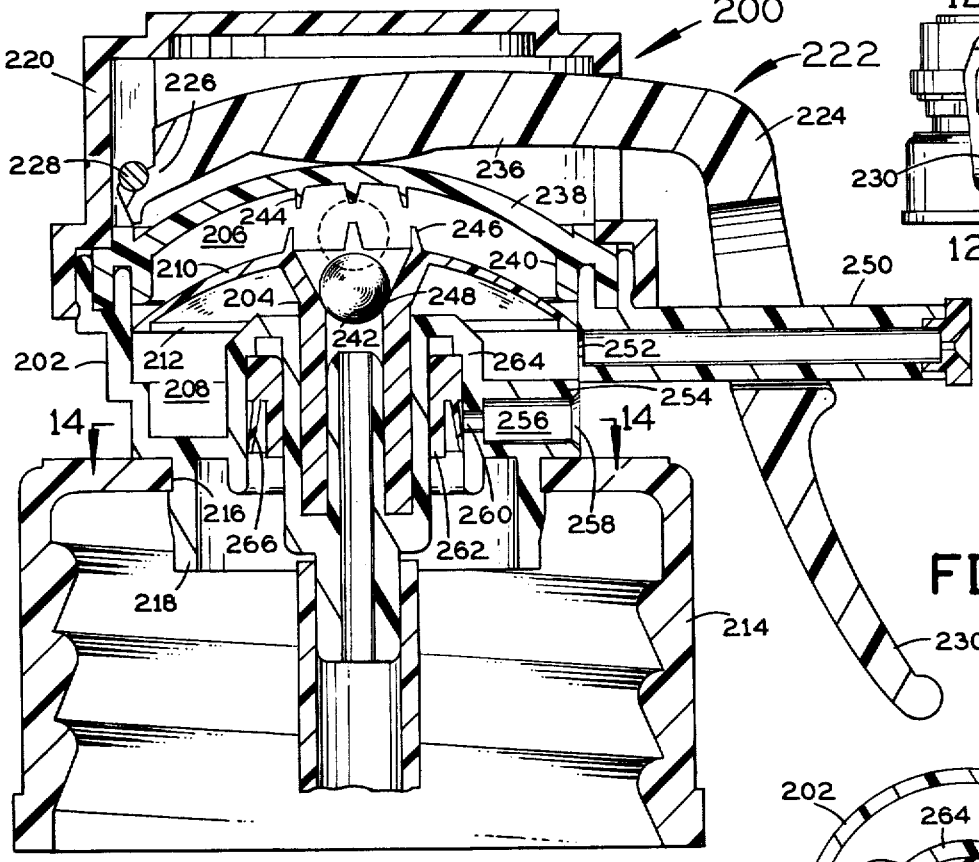
FIG. 12 is a vertical sectional view taken along line 12—12 of FIG. 11.
Figure 14:
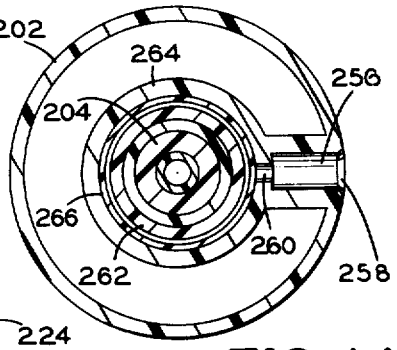
FIG. 14 is a cross-sectional view taken along line 14—14 of FIG. 12.
Figure 13:
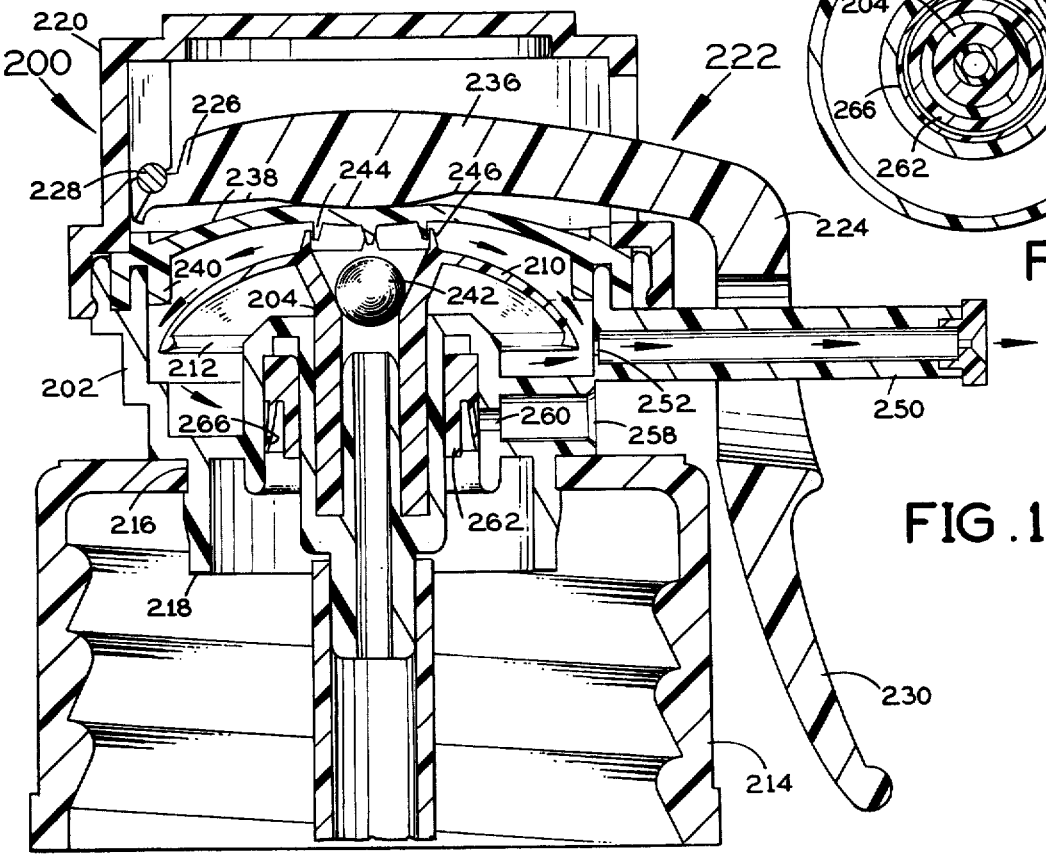
FIG. 13 is a vertical sectional view similar to FIG. 12, but showing the actuator in a depressed condition.
Figure 15:
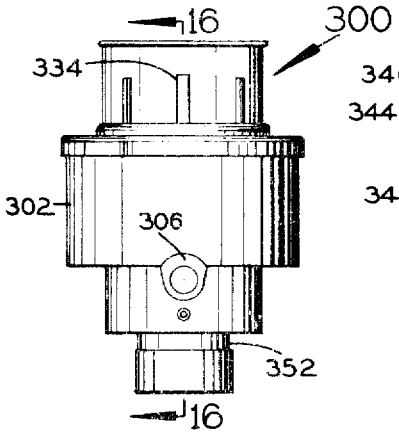
FIG. 15 is an elevational view of another embodiment of the invention.

When the actuator is depressed again to the condition shown in FIG. 7, product is forced past the circular sealing edge 94 which bends slightly to open the outlet valve. This product follows the path of the arrows in FIG. 7, and emerges from the output chamber through the spout 28.

It is desirable that the pump open and close at a predetermined pressure on the product in the pump, and this is particularly useful in low pressure applications. For this purpose, it has been discovered that the pump can be made to open at a predetermined low pressure by providing an outlet valve 88 in which the diameter of the circular sealing edge 94 is greater than ⅜", the thickness of the circular sealing edge is less than 0.020" and the flap 86 is made of low density plastic material such as polypropylene. It also helps to make the inner surface of the outlet opening 98 laterally elongated in the manner shown in FIGS. 5 and 6 so that the outlet opening 98 tapers inwardly from the inside of the openings to the outside of the opening. When the opening 98 is laterally elongated in the manner shown in FIGS. 5 and 6, the circular sealing edge 94 tends to open first right at the outlet opening by bending slightly only at that opening. This occurs with only a very low pressure applied to the actuator 26, so product can be forced out of the pump at a predetermined low pressure.

The pump 20 also includes a vent for venting the container, to which the pump is applied, to the atmosphere. A blocking member 114 blocks off a portion of the output chamber 84 to form a vent passage 116 for communicating the container to the atmosphere. The vent passage 116 leads through interrupted openings 118 in the rim 48 to the space inside the cap 24 which is located within the container when the pump is attached to a container. The passage 116 communicates with the atmosphere through a vent opening 120 formed in the wall of the housing 22. The blocking member 114 includes a resilient skirt 122 that is normally biased against the inside wall of the housing 22 just below the vent opening 120. The blocking member 114 includes an inner sealing portion 124 that fits sealingly on the projection 92, and an outer sealing portion 126 that fits sealingly against the inside surface of the housing 22. When pressure inside the container becomes reduced due to pumping of product out of the container through the pump, the pressure differential across the skirt 122 causes that skirt to bend inwardly to allow air under atmospheric pressure to enter through the opening 120 and the vent passage 116 into the container so as to equalize pressure within the container with atmospheric pressure. If the container is pliable, and if the container is squeezed, this would normally tend to force product out of the pump. However, the vent passage 116 is blocked off from the spout 28 by the sealing portions 124 and 126, so product cannot emerge from the spout. The inlet valve ball 120 can be locked on the inlet valve seat 100 as previously explained, so product cannot escape in that direction. The resilient sealing skirt 122 is only forced tighter against the vent opening 120 by product under pressure, so product cannot escape from the pump through the vent opening 120.

FIGS. 11 through 14 illustrate another embodiment of the invention. The pump illustrated in these figures is similar to the pump of FIGS. 1 through 10 so the entire description will not be repeated. The pump 200 includes a housing 202 which forms a compartment for receiving the valve member 204 that divides the compartment into an input chamber 206 and an output chamber 208. The valve flap 210 is made exactly in accordance with the previous description, and includes a circular sealing edge 212 that is biased against the inside surface of the housing 202. A cap 214 is snapped into a recess 216 in a lower projection 218 of the housing 202. An actuator cap 220 is snapped onto the housing 202, and the actuator 222 is received under the cap 220.

The actuator 222 includes a lever 224 that can be operated by one or more fingers of a person. The lever 224 includes a tip 226 that is snapped under a pin 228 formed in the cap 220 and the lever 224 pivots about the pin 228. The lever 224 includes a downwardly projecting outer arm 230 that forms a trigger to be actuated by the finger of a person. The lever 224 includes a horizontal arm 232 that rides on a flexible diaphragm 238 that is also part of the actuator. The diaphragm includes a peripheral sealing rim 240 that is sealingly received on the housing 202. The rim 240 is engageable by the circular sealing edge 212 if that edge should be pulled upwardly by excess pressure to prevent the sealing edge from being inverted.

The intake valve ball 242 is trapped within projections 244 on the diaphragm 238, and other projections 246 on the upper end of the valve member 204. These projections guide the ball and keep it in alignment with the valve seat 248.

The spout 250 emerges from the output chamber 208 in accordance with the previous description. The circular sealing edge 212 engages the inner surface of the housing 202 just above the outlet opening 252 as previously described.

A portion 254 of the housing 202 blocks off a vent passage 256 including a vent opening 258 from the remainder of the output chamber 208. The vent passage 256 communicates through another opening 260 formed in the housing 202 with the inside of the container. A blocking member 262 is sealingly inserted inside the portion 264 of the housing in which the opening 260 is formed, and this blocking member 262 includes a downwardly projecting resilient skirt which resiliently engages the housing portion 264 just below the opening 260. The skirt 266 normally blocks the vent passage, and the skirt is at an angle to the vent passage just as in the case of the skirt 122 in the other embodiment so that air can be admitted to the container when air pressure within the container is reduced below normal. Product cannot escape from the container when the container is squeezed or product is otherwise forced towards the vent passage 256.

It may be noted that the sealing portion 240 of the diaphragm serves to trap the inner end 226 of the lever 224 so that the lever cannot pop off the pin 228. In other respects, the pump of FIGS. 11 through 14 corresponds with the pump of FIGS. 1 through 10.

FIGS. 15 through 21 illustrate another embodiment of the invention which is similar to the embodiments already described. Thus, the entire description will not be repeated. The pump 300 includes a housing 302 and an actuator 304. Product emerges from a spout 306. A resilient, flexible flap 308 divides a compartment 310 into an input chamber 312 and an output chamber 314. An upward extension 316 for the housing forms an inlet 318 leading to the input chamber 312. The spout 306 forms an outlet for the output chamber 314.

A valve seat 320 is formed within a central opening 322 of the flap member 308, and a ball 324 normally rests on the valve seat 320 to close it. The flap 308 has a circular sealing edge 326 which is self-biased against the circular surface 328 to close the outlet passage formed by the spout 306. The flap has the dimensions and material described previously.

In this embodiment, the flap member 308 is slidable vertically relative to the inlet extension 316 to assist in allowing the pump to open and close at a low pressure. The flap member 308 is biased by a spring 330 to the rest position shown in FIG. 16. When pressure builds up in the pump due to pressurizing of product by the actuator 304, the flap member 308 moves to the lower position shown in FIG. 20 to allow product to escape past the sealing edge through the spout 306. This occurs at a very low pressure. The pressure of the product tends to bend the flap and the circular sealing edge 326 inwardly to reduce the friction of the sealing edge 326 against the circular surface 328, and this reduction of friction coupled with the vertical movement of the flap member helps to keep the operating pressure of the pump low.

The actuator 304 is essentially the same as described in connection with the embodiment of FIG. 1, so that description will not be repeated. However, the locking provisions are somewhat different. The piston 332 cooperates with the compartment 310. The piston 332 has angularly spaced, vertically elongated projections 334 on its outer surface, and these projections are normally received within corresponding slots in the cap member 336 which is attached to the housing 302. When the actuator is fully depressed, the projections 334 ride out of the slots in the cap member 336, and if the actuator is then turned, the actuator is locked in the fully depressed position shown in FIG. 21. In this position, the projection 338 of the piston 332 locks the ball 324 against the valve seat 320 to keep the pump closed. The pump may be unlocked by rotating the actuator until the projections 334 are again lined up with the slots in the cap member 336.

Figure 18:
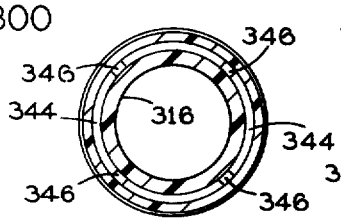
FIG. 18 is a cross-sectional view taken along line 18—18 of FIG. 16.
Figure 16:
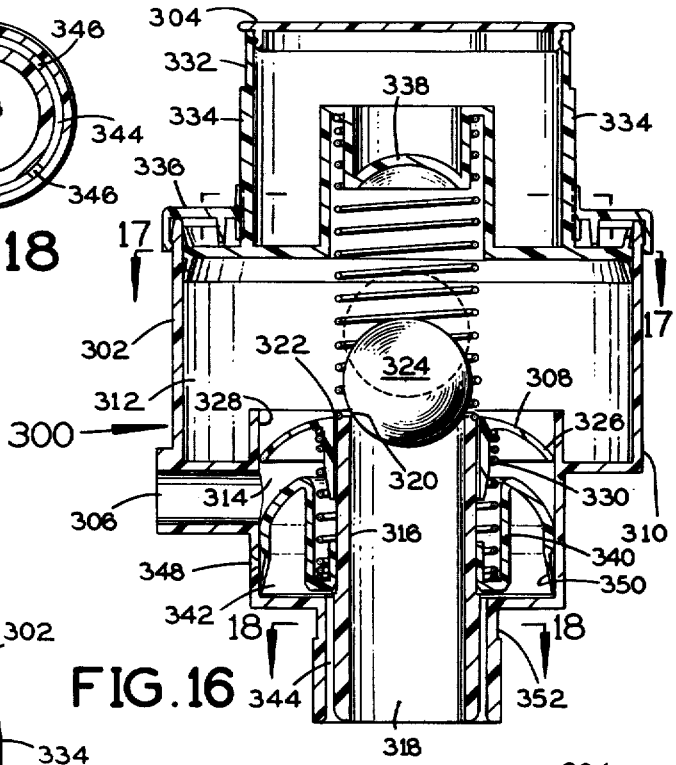
FIG. 16 is a vertical sectional view taken along line 16—16 of FIG. 15.
Figure 17:
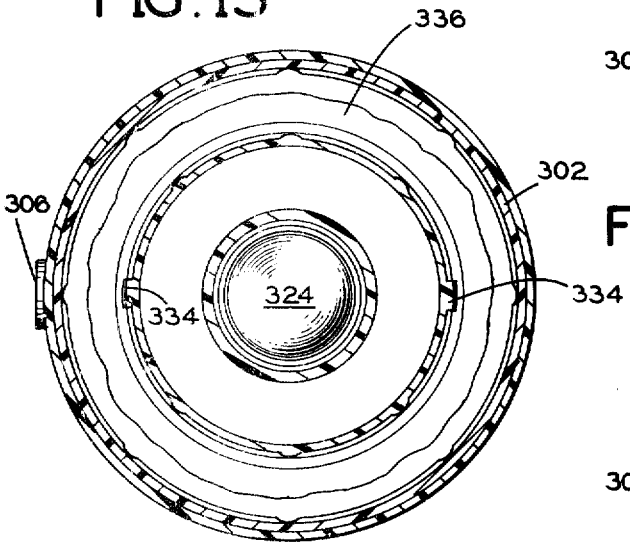
FIG. 17 is a cross-sectional view taken along line 17—17 of FIG. 16.
Figure 21:
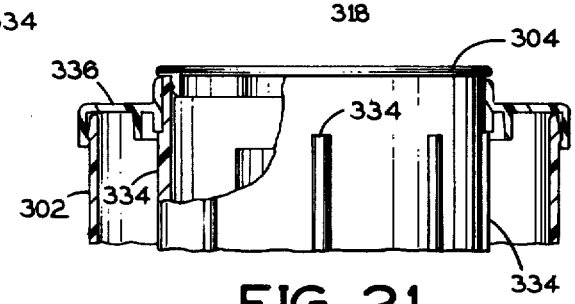
FIG. 21 is a fragmentary view showing a locking feature of the pump.
Figure 19:
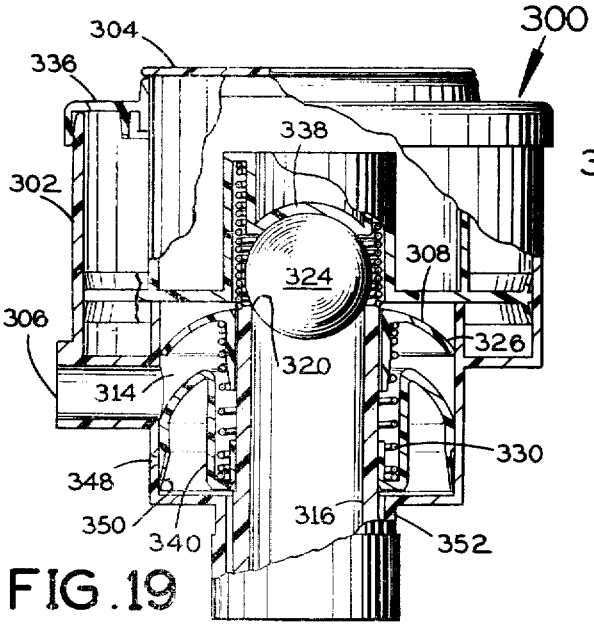
FIG. 19 is a vertical sectional view showing the pump in a locked condition.
Figure 20:
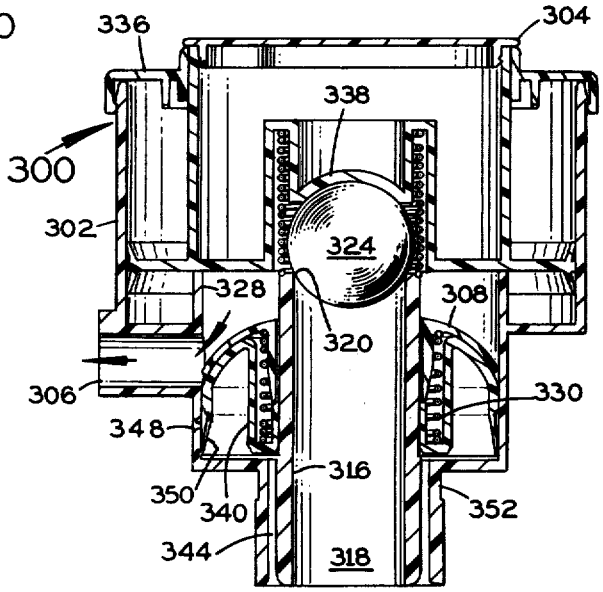
FIG. 20 is a vertical sectional view showing the pump dispensing product.

The venting arrangement is also very similar to that described previously. A blocking member 340 received in the lower portion of the housing 302 forms a vent passage 342 which leads through spaces 344 in the housing member. The spaces are defined by interrupted ribs 346 (FIG. 18). A vent opening 348 leads to the vent passage 342, and this vent opening is normally blocked by a circular skirt 350 formed on the blocking member 340. The skirt 350 will admit air through the vent opening 348 and the vent passage 342, and the spaces 344 to the container for the purpose of equalizing the air pressure within the container with atmospheric pressure.

The recess 352 receives a closure (not shown).

The compression resistance of spring 330 should be greater than the resistance to bending of edge 326.

In operation, with the pump primed, when a certain minimum pressure builds up (say 1 psi) during the downstroke of the actuator 304, the pressure of the product bends the sealing edge 326 away from the circular surface 328 to release the member 308. When pressure builds a little higher (say 1.5 psi) later in the downstroke of actuator 304, the resistance of the spring 330 is overcome, and member 308 moves down to the position shown in FIG. 20 so that product can escape through the spout 306 freely. As product escapes and the pressure on the product drops off, the spring 330 pushes the member 308 up to the position of FIG. 16 to cut off product flow from the spout. When the actuator 304 is in its upstroke, there is upward suction on the member 308 which helps to make the sealing edge 326 seal tightly against surface 328. This assures that the peripheral valve is fully closed.

In all embodiments, the sealing edge of the peripheral valve is free of any mold parting line or other imperfection which might impair the seal.

We claim:

1. In a pump for expelling fluid from a container including:

a compartment having an inlet passage and an outlet passage communicating therewith and having a cylindrical surface;

an intake valve for said inlet passage;

an exhaust valve for said outlet passage;

said exhaust valve comprising a resiliently flexible flap having a circular sealing edge engaging said cylindrical surface and slightly larger in diameter before assembly than the diameter of said cylindrical surface so that said flap bends slightly and is self biased against said cylindrical surface, said flap dividing the interior of said compartment into an input chamber with which said inlet passage communicates and an output chamber with which said outlet passage communicates;

said compartment including an actuator depressible into said input chamber to expel fluid therefrom past said sealing edge through said output chamber and out said outlet passage, and said actuator being returnable to suck fluid through said inlet passage past said intake valve into said input chamber:

the improvement comprising:

means blocking off a portion of said output chamber to form a vent passage for communicating the container to the atmosphere;

resilient sealing skirt means associated with said blocking means for normally closing said vent passage and yieldable to admit air through said vent passage to the container when air pressure in the container is reduced in operation;

said flap being movable vertically;

and a spring biasing said flap upwardly.

2. The pump as claimed in claim 1 in which said outlet passage is horizontally oblong for allowing relatively great product flow with relatively small movement of said circular sealing edge.

3. The pump as claimed in claim 1 in which said skirt means forms an acute angle with a wall of said passage for admitting air to the container when pressure therein is reduced and for blocking escape of product from the container through said passage to the atmosphere.

4. The pump as claimed in claim 3 in which the diameter of said circular sealing edge is greater than ½ inch, the thickness of said circular sealing edge is less than 0.020 inch, and said flap is made of low density plastic material for purposes of low pressure operation.

5. The pump as claimed in claim 1 in which said actuator includes a piston cooperating with said compartment, and said compartment and said piston have locking means for selectively locking said piston in a depressed position.

6. The pump as claimed in claim 5 in which said actuator has a projection engageable with said inlet valve in said locked, depressed position of said piston for locking said inlet valve closed.

7. The pump as claimed in claim 6 in which said piston is biased by a spring, said flap has a central opening in which is located a valve seat for said inlet valve, said inlet valve includes a ball normally seated on said valve seat and said spring encircles said ball for retaining said ball in alignment with said valve seat.

8. The pump as claimed in claim 7 in which said projection has a concave surface engageable with said ball for forming a pocket for said ball for enhancing flow of product in said compartment.

9. In a pump for expelling fluid from a container including:

a compartment having an inlet passage and an outlet passage communicating therewith and having a cylindrical surface;

an intake valve for said inlet passage;

an exhaust valve for said outlet passage;

said exhaust valve comprising a resiliently flexible flap having a circular sealing edge engaging said cylindrical surface and slightly larger in diameter before assembly than the diameter of said cylindrical surface so that said flap bends slightly and is self biased against said cylindrical surface, said flap dividing the interior of said compartment into an input chamber with which said inlet passage communicates and an output chamber with which said outlet passage communicates;

said compartment including an actuator depressible into said input chamber to expel fluid therefrom past said sealing edge through said output chamber and out said outlet passage, and said actuator being returnable to suck fluid through said inlet passage past said intake valve into said input chamber;

the improvement comprising:

means blocking off a portion of said output chamber to form a vent passage for communicating the container to the atmosphere;

resilient sealing skirt means associated with said blocking means for normally closing said vent passage and yieldable to admit air through said vent passage to the container when air pressure in the container is reduced in operation;

means blocking off a portion of said output chamber to form a vent passage for communicating the container to the atmosphere;

resilient sealing skirt means associated with said blocking means for normally closing said vent passage and yieldable to admit air through said vent passage to the container when air pressure in the container is reduced in operation;

and in which said flap is vertically movable and biased by a spring.

10. In a pump for expelling fluid from a container including:

a compartment having an inlet passage and an outlet passage communicating therewith and having a cylindrical surface;

an intake valve for said inlet passage;

an exhaust valve for said outlet passage;

said exhaust valve comprising a resiliently flexible flap having a circular sealing edge engaging said cylindrical surface and slightly larger in diameter before assembly than the diameter of said cylindrical surface so that said flap bends slightly and is self biased against said cylindrical surface, said flap dividing the interior of said compartment into an input chamber with which said inlet passage communicates and an output chamber with which said outlet passage communicates;

said compartment including an actuator depressible into said input chamber to expel fluid therefrom past said sealing edge through said output chamber and out said outlet passage, and said actuator being returnable to suck fluid through said inlet passage past said intake valve into said input chamber;

the improvement comprising: means blocking off a portion of said output chamber to form a vent passage for communicating the container to the atmosphere;

resilient sealing skirt means associated with said blocking means for normally closing said vent passage and yieldable to admit air through said vent passage to the container when air pressure in the container is reduced in operation;

said entire flap being movable vertically;

and spring means biasing said flap upward and having greater compression resistance than the resistance of said sealing edge to bending whereby said sealing edge bends to release said flap and said flap moves down to dispense product in the operation of said pump.

11. In a pump for expelling fluid from a container including:

a compartment having an inlet passage and an outlet passage communicating therewith and having a cylindrical surface;

an intake valve for said inlet passage;

an exhaust valve for said outlet passage;

said exhaust valve comprising a resiliently flexible flap having a circular sealing edge engaging said cylindrical surface and slightly larger in diameter before assembly than the diameter of said cylindrical surface so that said flap bends slightly and is self biased against said cylindrical surface, said flap dividing the interior of said compartment into an input chamber with which said inlet passage communicates and an output chamber with which said outlet passage communicates;

said compartment including an actuator depressible into said input chamber to expel fluid therefrom past said sealing edge through said output chamber and out said outlet passage, and said actuator being returnable to suck fluid through said inlet passage past said intake valve into said input chamber;

the improvement comprising:

said entire flap being movable axially;

and spring means biasing said flap in one direction and having greater compression resistance than the resistance of said sealing edge to bending whereby said sealing edge bends to release said flap and said flap moves in the opposite direction to dispense product in the operation of said pump.

* * * * *